US006073527A

United States Patent [19]

Harter et al.

[11] Patent Number: 6,073,527

[45] **Date of Patent: *Jun. 13, 2000**

[54] METHOD AND APPARATUS FOR DIRECT SHINGLING OF CUT SHEETS AT THE CUTOFF KNIFE

[75] Inventors: Richard W. Harter; Dennis L. Lemke; James R. Michler, all of Phillips, Wis.

[73] Assignee: Marquip, Inc., Phillips, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,051

[22] Filed: Apr. 11, 1997

[51] Int. Cl.[7] ..... B26D 1/40

[52] U.S. Cl. ..... 83/88; 83/110; 83/155; 83/342; 83/345

[58] Field of Search ..... 83/24, 27, 37, 83/88, 100, 110, 152, 342, 345, 155, 155.1; 271/197, 202, 203

[56] References Cited

U.S. PATENT DOCUMENTS

| | | | |
|---|---|---|---|
| 3,336,028 | 8/1967 | Schonmeier | 271/74 |
| 4,200,016 | 4/1980 | Helmig et al. | 83/88 |
| 4,399,727 | 8/1983 | Omori et al. | 83/37 X |
| 4,667,953 | 5/1987 | Hirakawa et al. | 83/88 X |
| 4,756,219 | 7/1988 | Pohl et al. | 83/342 X |
| 4,776,577 | 10/1988 | Marschke et al. | 271/197 X |
| 5,014,582 | 5/1991 | Teik | 83/24 |
| 5,125,303 | 6/1992 | Hoyland | 83/88 X |
| 5,161,442 | 11/1992 | Rilitz et al. | 83/345 X |
| 5,193,423 | 3/1993 | Bakker | 83/24 |
| 5,275,394 | 1/1994 | Mank et al. | 271/203 X |
| 5,644,941 | 7/1997 | Stodt et al. | 83/345 X |
| 5,950,510 | 9/1999 | Scheffer . | |

*Primary Examiner*—Kenneth E. Peterson
*Attorney, Agent, or Firm*—Andrus, Sceales, Starke & Sawall

[57] ABSTRACT

Shingling of paperboard sheets cut from a web with a helical blade cutoff knife utilizes the downward deflection of the trailing edge of the cut sheet and simultaneous lifting of the leading edge of the web to position the sheets for shingling immediately downstream of the knife. A vacuum outfeed conveyor takes advantage of the initial downward deflection of the sheet caused by cutting to pull the trailing edge of the sheet onto the vacuum conveyor which is simultaneously slowed relative to the lead edge of the advancing web. In the preferred embodiment, vacuum is continuously applied and the conveyor is accelerated back to line speed as soon as the leading end of the web is pulled onto the vacuum conveyor.

5 Claims, 3 Drawing Sheets

METHOD AND APPARATUS FOR DIRECT SHINGLING OF CUT SHEETS AT THE CUTOFF KNIFE

BACKGROUND OF THE INVENTION

The present invention pertains to shingling of cut sheets and, more particularly, to an apparatus and method for shingling sheets immediately after cutoff and directly as the cut sheets exit the cutoff knife.

In the dry end conversion of a corrugated paperboard web, the continuously moving web, which may have already been longitudinally slit and/or scored, advances through a rotary cutoff knife where the web is cut crosswise into sheets of selected length. The cut sheets are conveyed into a stacking device where stacks of sheets are formed and transferred away for further processing. In a modern corrugator dry end, the cutoff knife comprises a pair of counterrotating rotary knives with helical cutting blades. Variable speed drive systems are utilized to control blade speed to cut sheets of widely varying lengths from the web which may be running at the speeds in excess of 1,000 feet per minute.

In order to slow the cut sheets for stacking without damage and to shorten the length of the conveyor system delivering sheets to the stacker, cut sheets are typically formed into a shingle at some point downstream from the cutoff knife, thereby allowing the stream of sheets to enter the stacker at a speed substantially below web line speed. Furthermore, to enhance sheet handling, cut sheets are typically accelerated slightly after cutoff (e.g. to about 110% of web line speed) to form a slight gap between successive sheets. However, this adds to the total length of the system between the cutoff knife and the stacker.

SUMMARY OF THE INVENTION

In accordance with the present invention, cut sheets are initially shingled at the cutoff knife in a manner which utilizes one mode of helical blade cutoff knife operation to commence vertical downward deflection of the tail end of the cutoff sheet, followed by sheet capture and shingling on a vacuum conveyor positioned immediately downstream of the cutoff knife.

In accordance with the present invention, an apparatus which operates to shingle paperboard sheets which are cut from a continuous running web operating at a constant line speed utilizes a rotary helical blade cutoff knife and includes means for operating a counterrotating pair of interacting helical blades with the upper blade edge positioned rotationally ahead of the lower blade edge to cut a sheet from the leading end of the web and to cause the trailing edge of the sheet to be deflected vertically downwardly relative to the leading edge of the web, which leading edge is simultaneously lifted upwardly. A vacuum outfeed conveyor is positioned below the sheet cut line and immediately downstream of the knife, and control means are provided to control either the speed of the outfeed conveyor or the vacuum applied to the outfeed conveyor to cause the leading edge of the web to overlap the trailing edge of the cut sheet.

When the outfeed conveyor is operated at a variable speed, the vacuum is applied continuously to the outfeed conveyor. In this mode, the control means is operative to maintain the outfeed conveyor speed at approximately line speed until the cut is complete, and thereafter to decrease the speed of the outfeed conveyor to effect the initial shingling overlap. Decreased outfeed conveyor speed is maintained until the lead edge of the web is captured by the vacuum outfeed conveyor.

Alternately, where the outfeed conveyor is operated at a constant speed, a speed is chosen less than line speed. In this embodiment, vacuum is applied to the outfeed conveyor in response to completion of the cut. The control means is operative to maintain vacuum on the outfeed conveyor until the trailing edge of the cut sheet clears an upstream length of vacuum conveyor sufficient to capture the lead edge of the web.

In accordance with the corresponding method of the present invention, cut sheets are shingled at the knife by the steps of operating a counterrotating pair of helical cutting blades with the upper blade edge positioned rotationally ahead of the lower blade edge to cause a downward deflection of the trailing edge of the cut sheet relative to the leading edge of the web from which it is cut, positioning a vacuum outfeed conveyor below the sheet cut line and immediately downstream of the knife, and controlling either the speed of the outfeed conveyor or the vacuum applied to the outfeed conveyor to cause the leading edge of the web to overlap the trailing edge of the cut sheet. In accordance with the preferred embodiment, the step of controlling comprises operating the outfeed conveyor at a variable speed. The preferred method also includes the step of applying a vacuum to the outfeed conveyor continuously. Further, the method includes the steps of maintaining the outfeed conveyor speed at approximately web speed until the cut is complete, and decreasing the speed of the outfeed conveyor upon completion of the cut. The method also includes the steps of maintaining decreased outfeed conveyor speed until the lead edge of the web overlaps the trailing edge of the most recently cut sheet and returning the outfeed conveyor to line speed before the lead edge of the web is captured by the vacuum of the conveyor.

In accordance with an alternate embodiment, the controlling step comprises operating the outfeed conveyor at a constant speed which is less than web line speed. The method preferably includes the steps of applying vacuum to the outfeed conveyor in response to completion of the cut, and maintaining the vacuum on the outfeed conveyor until the trailing edge of the cut sheet clears an upstream length of exposed vacuum on the outfeed conveyor sufficient to capture the lead edge of the web.

DETAILED DESCRIPTION OF THE PREFERRED EMBODIMENTS

Figure 1:
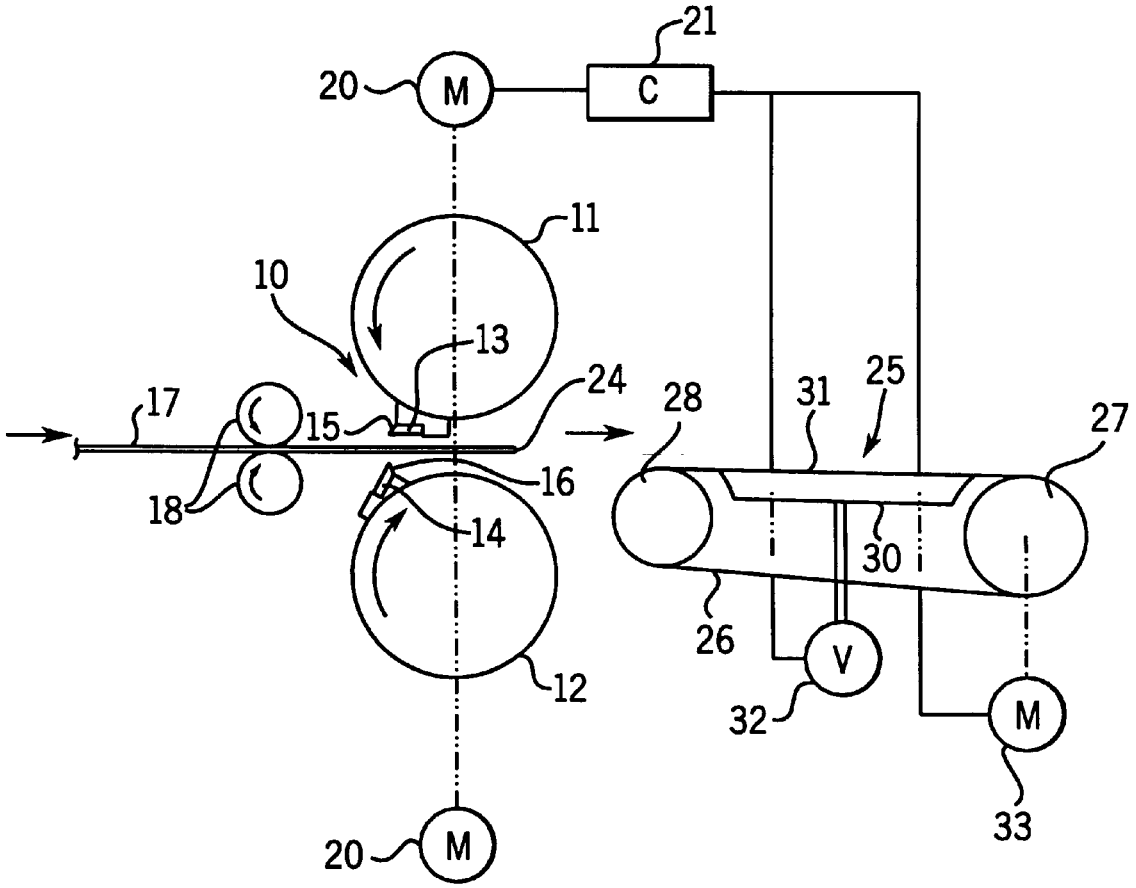
FIG. 1 is a generally schematic side elevation of a helical blade cutoff knife of the type used in the present invention.
Figure 2A:
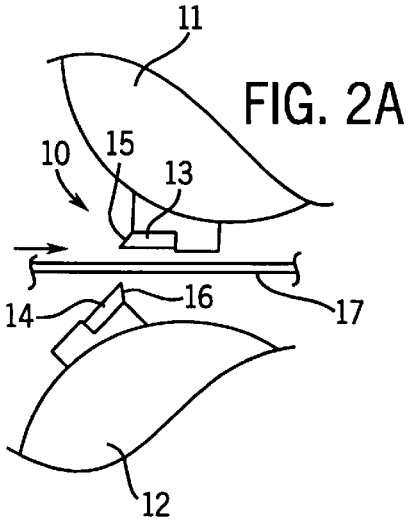
FIGS. 2A–F are enlarged details showing the progressive interaction of the rotary knife blades on the running web to effect sheet cut.
Figure 2D:
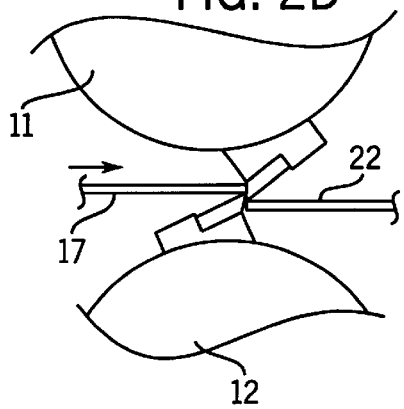
Figure 2B:
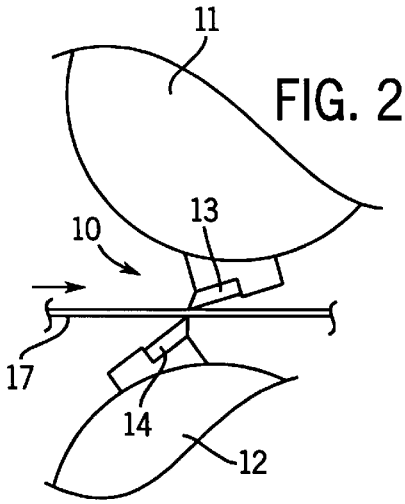
Figure 2E:
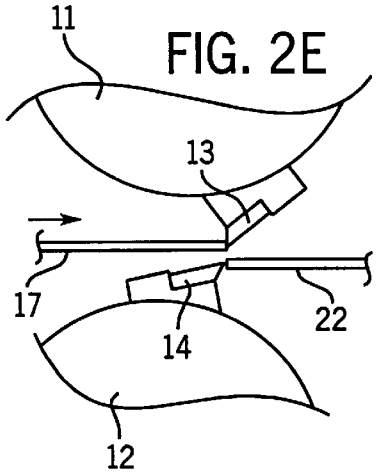
Figure 2C:
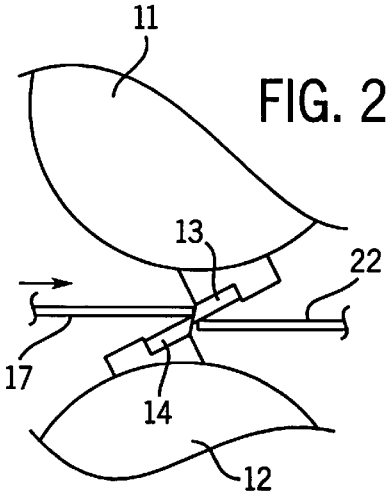
Figure 2F:
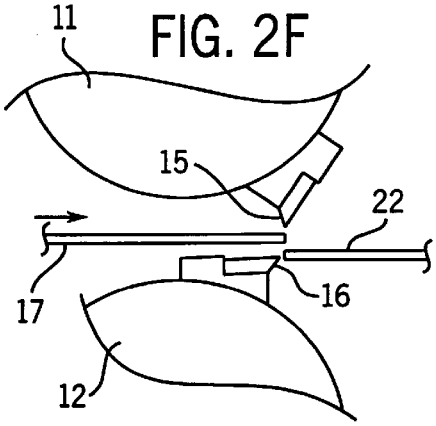

FIG. 1 shows a conventional rotary cutoff knife 10 comprising an upper knife cylinder 11 and a lower knife cylinder 12. Each of the knife cylinders 11 and 12 has a helical blade 13 and 14 attached to its outer surface. The cylinders are driven in opposite rotational directions and are positioned to cause the upper and lower blade edge faces 15 and 16 to overlap to cross cut a web 17 passing between the knife cylinders.

The web 17 is typically moved at a constant speed and directed through the knife by a pair of driven web-engaging pull rolls 18 just upstream of the knife 10, in a manner well known in the art. Also in a well known manner, the knife cylinders 11 and 12 are driven to match the peripheral blade edge speed to the speed of the running web 17. An electronic controller 21 controls blade acceleration and speed to vary the length of sheets 22 cut from the running web.

Referring now to FIGS. 2A–F, there is shown the interaction between the upper and lower knife blades 13 and 14 at one point along their lengths as a sheet 22 is cut from the running web 17. The actual cut is effected by a shearing action between the overlapping blade faces 15 and 16 as the helical blades interengage. The blades must necessarily be positioned with one of the blades rotationally slightly ahead of the other in order to effect the cutting action. In accordance with the present invention, the knife 10 is operated with the upper helical blade 13 rotationally ahead of the lower helical blade 14. As may be seen in the sequence of FIGS. 2A–F, the cutting action of the interengaging knife blades 13 and 14 causes the trailing edge 23 of the cut sheet 22 to be displaced downwardly and, simultaneously, the leading edge of the web 24 to be displaced in the opposite upward direction. It is an important aspect of the present invention to utilize the initial downward displacement of the trailing edge 23 of the sheet as it exits the cutoff knife end to permit the cut sheet to be directed toward a vacuum outfeed conveyor 25 in a manner to effect preliminary shingling, as will be described.

In prior art systems, the cut sheets exiting the cutoff knife are typically accelerated slightly by directing the sheets sequentially through the nip of a driven exit roll and cooperating holddown wheels to longitudinally space the adjacent edges of the cut sheets to facilitate downstream handling. The stream of the spaced cut sheets is directed into the downstream shingling section of the stacker and the sheets are shingled prior to stacking in the manner generally described above. In the system of the present invention, the vacuum outfeed conveyor 25 replaces the exit roll and holddown wheels and at least a portion of the shingling section of the stacker, as well as the conventional jam pan positioned at the exit roll.

In accordance with the system of the preferred embodiment, the vacuum outfeed conveyor 25 includes a sheet-conveying belt means 26 which may comprise a series of narrow laterally spaced belts or a single belt provided with a pattern of through holes covering substantially the entire belt surface. The belt means 26 is entrained around a driven head pulley 27 and a tail pulley 28. A vacuum plenum 30 is positioned below the upper conveying run 31 of the belt means 26 to apply vacuum to the belt surface, either through spaces between the narrow belts or, alternately, the through holes in the unitary belt. Both types of vacuum conveyors are well known in the art. Vacuum is applied to the vacuum plenum 30 via a source of negative pressure 32. In this embodiment of the invention, a constant vacuum is applied to the vacuum plenum 30 and the speed of the outfeed conveyor 25 is varied by utilizing the controller 21 to vary the speed of a motor 33 driving the conveyor head pulley 27.

Figure 3:
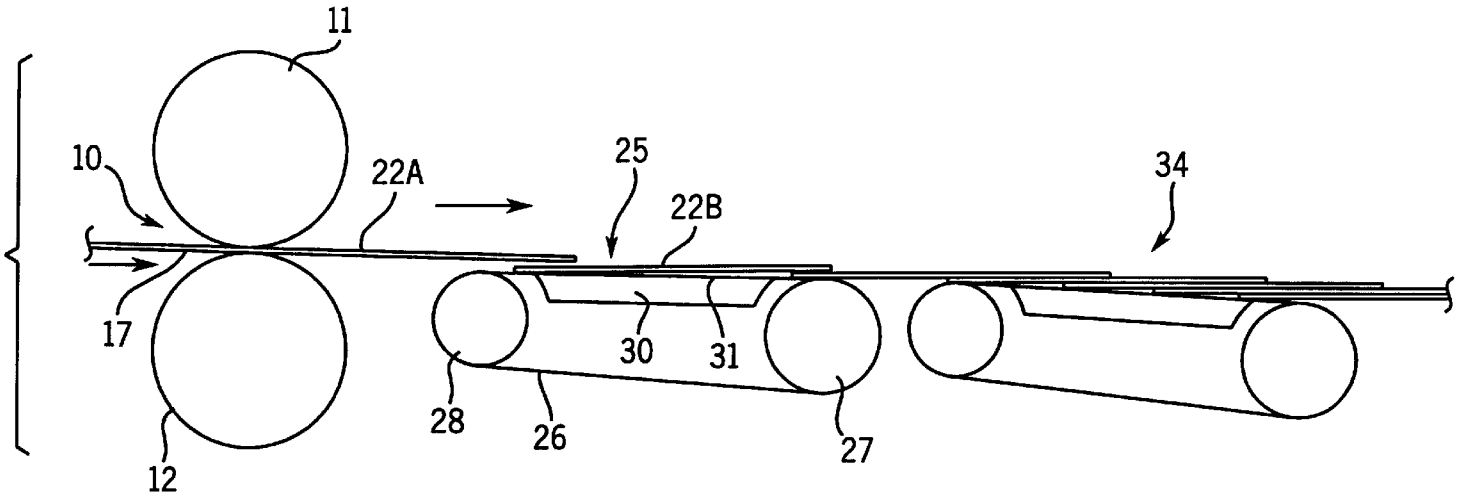
FIGS. 3 and 4 are side elevations of the apparatus of the present invention showing how shingling is effected.
Figure 4:
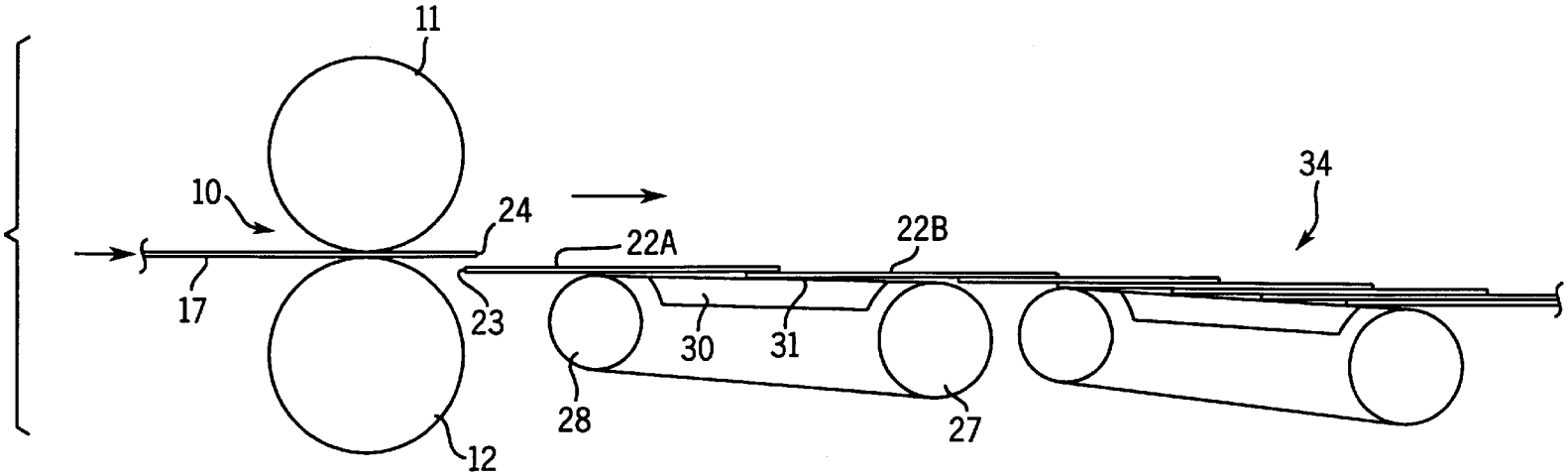

The outfeed conveyor 25 is positioned with its tail pulley 28 spaced closely downstream from the lower knife cylinder 12 and with the conveying run 31 of the conveyor generally horizontal and 1–2" below the knife cut line. As indicated above, the cutting action of the knife blades provides a downward movement of the sheet trailing edge 23 as the cut is completed. At that point, the sheet 22 is pulled onto the conveying run 31 of the belt by the influence of the applied vacuum. Simultaneously with completion of the cut, the vacuum conveyor 25 is slowed in response to a control signal from the controller 21 to the drive motor 33. This is shown in the progression of sheet 22A from its FIG. 3 position to its FIG. 4 position. When the vacuum conveyor is slowed at completion of the cut, the leading edge 24 of the web continues to advance at line speed and, as shown in FIG. 4, begins to overlap the trailing edge 23 of sheet 22A. The vacuum outfeed conveyor 25 is maintained at the lower shingling speed until the trailing edge of the preceding downstream sheet, sheet 22B in FIG. 3, has advanced far enough to expose an upstream portion of the vacuum plenum 30 sufficient to capture the leading edge of the web 17 which is about to be cut to form sheet 22A.

The overlap or percent shingle which may be attained on the vacuum outfeed conveyor 25 depends on sheet length and web line speed, but in any event is substantially less than 50% at line speeds of 1,000 feet per minute and higher. As a result, the shingle must typically be increased or compressed in a downstream operation. Compression of the shingle may occur in a second vacuum conveyor 34 positioned immediately downstream of the vacuum outfeed conveyor 25 and receiving the preshingled sheets therefrom. For example, with a line web speed of about 1,000 feet per minute and the cutoff knife 10 operating to cut 17" sheets, a sheet overlap or shingle of about 10" may be attained by operating the slow speed stage of the vacuum outfeed conveyor at about 400 feet per minute.

Timing of speed control of the vacuum outfeed conveyor 25 is very important. The conveyor must be returned to full line speed at the time the lead end of the trailing web is pulled by exposed vacuum onto the upstream portion of the conveyor as the preceding sheet moves in the downstream direction. Otherwise, if the vacuum conveyor captures the lead end of the web while the outfeed conveyor is operating at the lower shingling speed, a thin web may be caused to buckle and a heavy web may slip with respect to the preceding sheet. In either case, cut accuracy may be adversely affected.

In an alternate mode of operation, vacuum outfeed conveyor 25 is operated at a constant speed that is below line speed of the web 17, for example, 50% of line speed. Application of the vacuum from the vacuum source 32 to the vacuum plenum 30 is controlled to switch the vacuum on when the cut is completed and then to switch the vacuum off when the trailing edge of the cut sheet clears enough of the upstream portion of the vacuum conveyor 25 that the vacuum begins to pull down the advancing web. Although this alternate method of operation has the advantage of permitting the use of a smaller drive motor 33 for the vacuum conveyor, the accuracy of the shingling process cannot be controlled as well as in the preferred embodiment. This alternate embodiment also has the disadvantage of loss of control of the last sheet of the web during tailout.

We claim:

1. An apparatus for shingling sheets being cut from a continuous running web operating at a constant line speed utilizing a rotary helical blade cutoff knife having a counterrotating pair of interacting upper and lower helical cutting blades, each of said cutting blades having a blade edge, said apparatus comprising:

means for operating the interacting helical blades with the upper blade edge positioned rotationally ahead of the lower blade edge to cut a sheet from a leading edge of the web along a transverse cut line of the cutoff knife and to cause a vertical downward deflection of a trailing edge of the cut sheet relative to a new leading edge of the web;

a vacuum outfeed conveyor positioned below the cut line of the cutoff knife and immediately downstream of the knife to receive the cut sheet directly from the knife without any elements contacting or supporting said sheet between the cutoff knife and the outfeed conveyor;

a vacuum source operatively connected to said outfeed conveyor to apply a vacuum force sufficient to hold a cut sheet thereon; and, means for variably controlling one of either the speed of the outfeed conveyor or the vacuum applied to the outfeed conveyor immediately after cutoff to capture the downwardly deflected cut sheet on the outfeed conveyor and to permit the new leading edge of the web to overlap the trailing edge of the cut sheet on the outfeed conveyor.

2. The apparatus as set forth in claim 1 wherein said outfeed conveyor is operated at a variable speed.

3. The apparatus as set forth in claim 2 wherein the vacuum is applied continuously to the outfeed conveyor.

4. The apparatus as set forth in claim 3 wherein said controlling means is operative to maintain the outfeed conveyor speed at approximately line speed until the cut is complete and thereafter to decrease the speed of the outfeed conveyor.

5. The apparatus as set forth in claim 4 wherein said controlling means is operative to maintain the decreased speed of the outfeed conveyor until the leading edge of the web is captured by said outfeed conveyor.

* * * * *